United States Patent [19]

Wuu

[11] Patent Number: 4,885,878

[45] Date of Patent: Dec. 12, 1989

[54] ADVANCED STATE OF THE ART MOVIE THEATER

[76] Inventor: George Wuu, 1000 E. Coast Parkway, Singapore 1544, Singapore

[21] Appl. No.: 93,889

[22] Filed: Sep. 8, 1987

[51] Int. Cl.[4] ..... E04H 3/10

[52] U.S. Cl. ..... 52/6; 52/7; 358/104

[58] Field of Search ..... 52/6, 7, 8, 10, 80, 52/81; 358/88, 93, 104

[56] References Cited

U.S. PATENT DOCUMENTS

| | | | |
|---|---|---|---|
| 3,399,887 | 9/1968 | Altier | 52/7 X |
| 3,945,160 | 3/1976 | Grosser et al. | 52/81 |
| 4,634,384 | 1/1987 | Neves et al. | 358/104 X |
| 4,642,945 | 2/1987 | Browning et al. | 52/6 X |

*Primary Examiner*—David A. Scherbel
*Assistant Examiner*—Creighton Smith
*Attorney, Agent, or Firm*—Charles C. Logan, II

[57] ABSTRACT

An advanced state of the art movie theater whose building is formed in the shape of a spherical geodesic dome. A platform within the dome is spaced upwardly a predetermined height from the bottom surface of the building. The inside wall surface of the building functions as a motion picture screen having an arc of approximately 300 degrees. Six hydraulically operated telescopic legs each have their top ends pivotally connected to the bottom surface of the platform and their bottom ends are pivotally connected to base plates on the support surface. A motion picture projector having a 300 degree fish-eye lens is oriented within the building to project an image on the motion picture screen. Between 50 to 100 seats are mounted on the platform and oriented toward the motion picture screen to accomodate persons viewing the motion picture. Harness-type seat belts would be attached to these seats. An electronic control system is used to tilt the platform upwardly and downwardly in any direction about its vertical axis in all 360 degrees. The electronic control system would be coordinated with the motion picture to be viewed to give the cinema viewer a vivid sensation of seeing and feeling the action in a story as if being there.

2 Claims, 3 Drawing Sheets

ADVANCED STATE OF THE ART MOVIE THEATER

BACKGROUND OF THE INVENTION

The invention relates to a movie theater and more specifically to an advanced state of the art movie theater.

Presently, most movie theaters are conventional and remain much the same as they have been for the last forty or fifty years. Improvements have been made in the sound systems and also in the projection equipment used to show the movies. There have been occasional attempts to provide a greater feeling of reality to the viewer. Some of these systems have utilized wider screens and special movie making cameras and movie projectors. Other systems have addressed the sound system and attempted to place the viewer in the middle of the sounds that would be observed by the viewer if he were in the scenes of the movie. Another attempt has been to tap the viewers sense of smell by providing the viewer with a card which would be scratched at different times during the movie to produce smells that would be recognized. Some theaters have even been designed to project the movie on the ceiling of the theater and they place the viewer in seats that are oriented toward the ceiling. Other theaters have even installed mechanical structure for vibrating the seats to provide additional realism.

It is an object of the invention to provide a novel movie theater that upgrades and creates a greater feeling of reality to the cinema patron.

It is also an object of the invention to provide a novel theater that represents a culmination of the technologies from a cinema and an aircraft simulator.

It is another object of the invention to provide a novel movie theater that utilizes a projector having a 300 degree fish-eye lens thereby giving a wraparound feeling.

It is an additional object of the invention to provide a novel movie theater in which the patrons seats are mounted on a platform that can be tilted upwardly and downwardly in any of the 360 degree range about the vertical axis of the platfrom.

SUMMARY OF THE INVENTION

Applicant's invention is related to an advanced state of the art movie theater. The building for the theater would have a dome-like spherical configuration that is formed of geodesic triangular panels. The inner wall surface of the building would function as a curved motion picture screen surface and provide at least 300 degrees of an arc for projecting the movie thereupon. The dome would have a diameter of approximately 20 meters.

Located within the dome would be a platform that would be spaced approximately 8 to 10 feet above ground level. Approximately 50 to 100 seats would be mounted on its top surface and these seats would be equipped with harness-type seat belts. The seats would be oriented so that the viewers would be able to view the 300 degree arcuate motion picture screen surface.

A projector having a 300 degree fish-eye lens would be oriented to project an image on the motion picture screen. An 8 channel sound system would be located within the interior of the dome. The motion picture screen would have a height of approximately 10–20 feet.

Six hydraulically telescopic legs have their top ends pivotally connected to the bottom surface of the platform and their bottom ends are pivotally connected to base plates on the support surface. The platform is engineered to withstand stress from human load as well as the sudden thrust, jerk, vibration, drop, lift, tilt and turning actions that can be produced by utilizing the six hydraulically telescopic legs. The components of the hydraulically operated support legs have a power pack, control valves and its sub-system is integrated to an electronic control system. The components are similar to existing components used on robotics and aircraft simulators.

The electronic control system is the brains of the system. It would have a controller that is the center of the entire electronic system. With the command button situated on the control panel together with the emergency stop button, the operator activates the appropriate button to start the movie. Joysticks are part of the electronic control system and these are used for motion programing of the platform. Essentially, the computer memorizes the platform motion described by the joystick and plays it back exactly the same way time after time. Motion profiles are digital recorded by the computer. Another important part of the electronic control system is the operator console. It is used for the operation of the main computer. All system controls originate from this computer. Motion profiles are stored on floppy diskettes and new/different programs are loaded by means of operator commands entered at the keyboard. The human interface shall be menu-driven so as to minimize the amount of operator training required.

The slave computer, power supplier, analog electronics and valve drivers are other components of the electronic control system. This sub-system executes the servo control loops for all six hydraulic cylinders and supplies power to drive the hydraulic valves.

The advent of applicant's novel 300 degree theater system offers an unlimited variety of new experiences for the film-goer and thrill-seekers. Shooting and programing possibilities become boundless. Some of the categories where the "you are there" feeling would be produced are for tourist sightseeing movies, simulated experiences and journeys, adventure movie themes, and educational and training films.

DESCRIPTION OF THE PREFERRED EMBODIMENT

Figure 1:
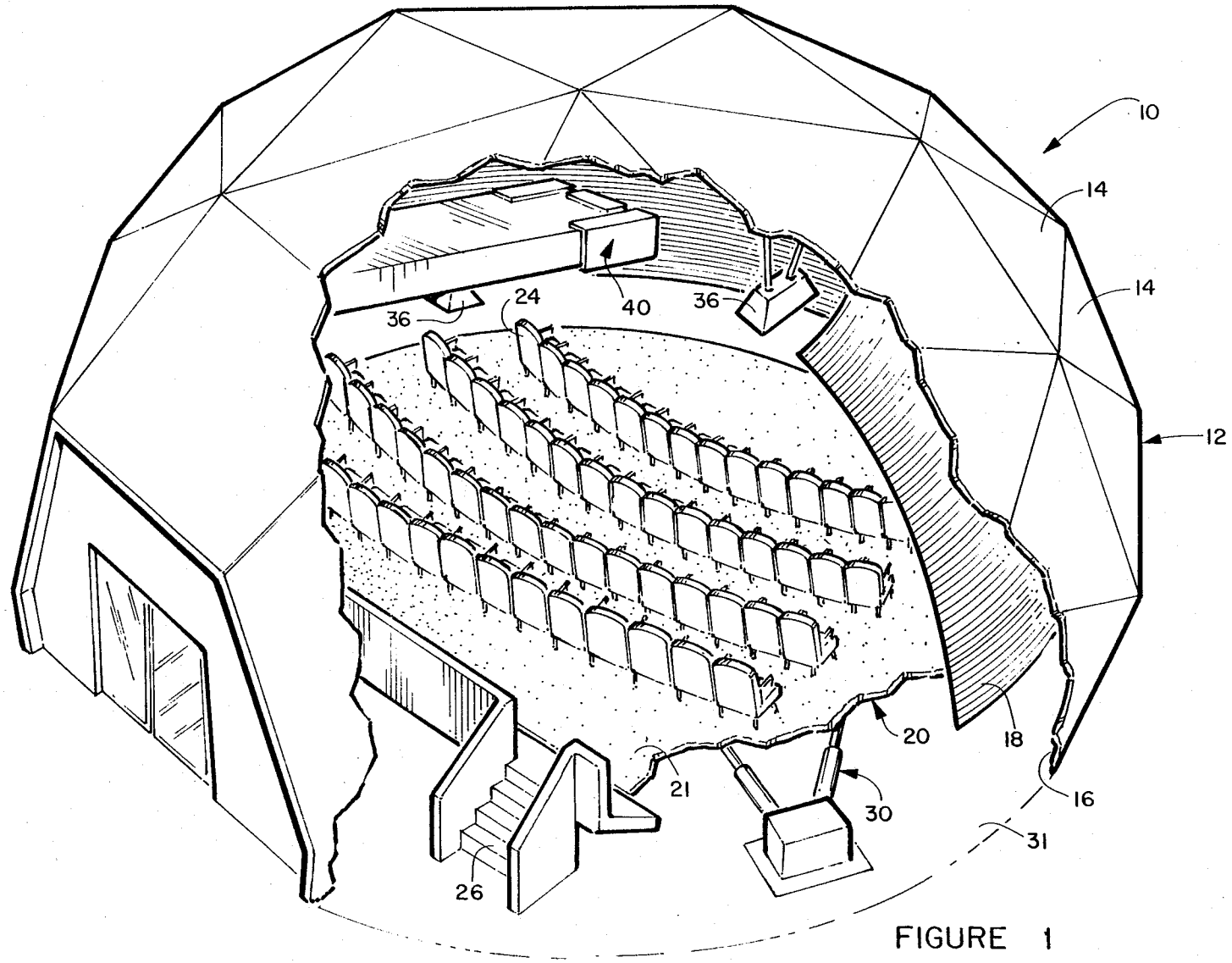
FIG. 1 is a perspective view of applicant's novel movie theater with portions broken away for clarity.
Figure 2:
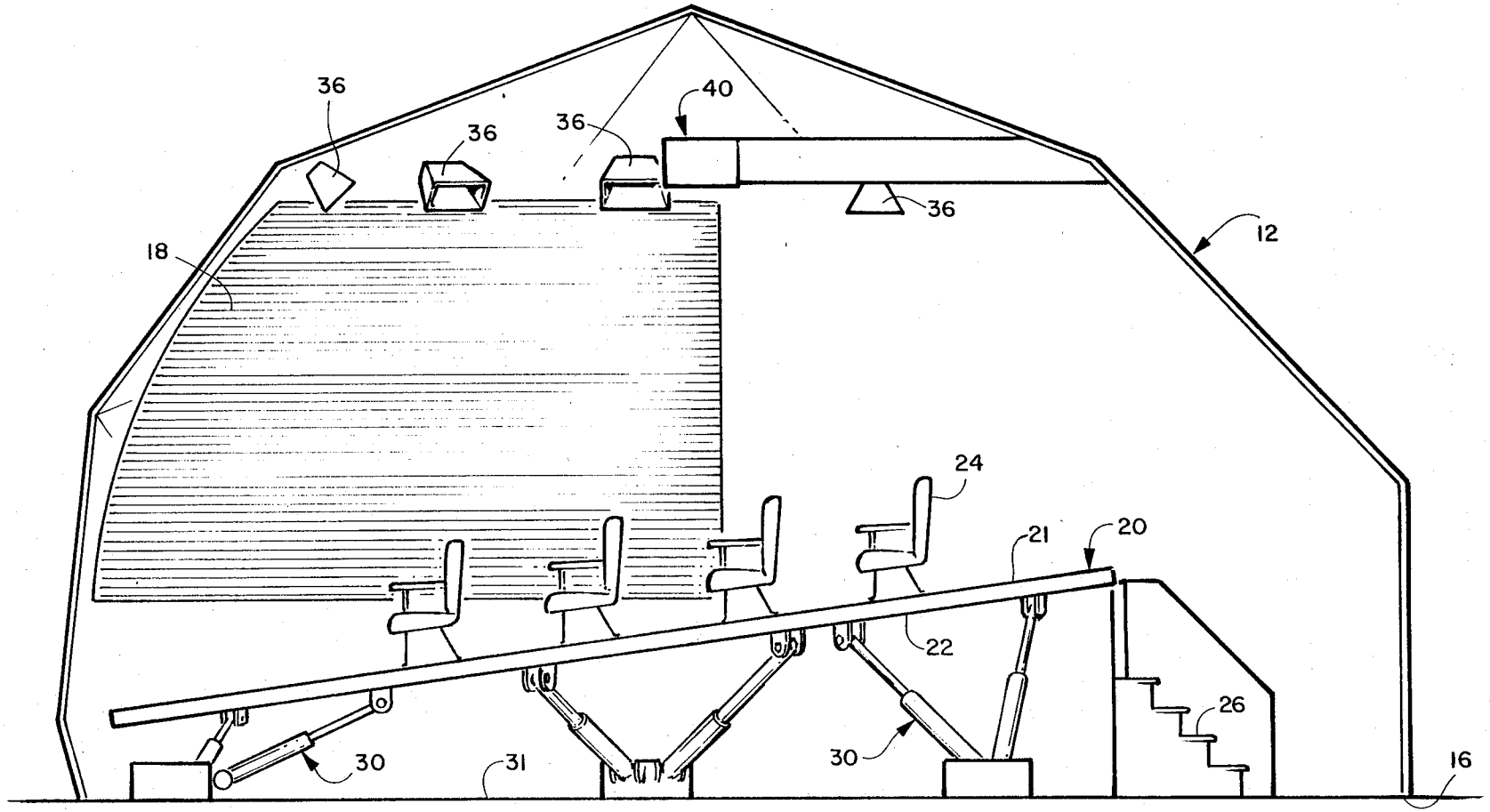
FIG. 2 is a schematic elevation view of the interior of the theater.

Applicant's novel advanced state of the art movie theater is generally designated numeral 10 and will be described by referring to FIGS. 1–4 of the drawings.

The building of the theater is identified by numeral 12. It is in the form of a dome-shaped sphere formed from triangular geodesic panels 14. The walls of the building 12 have a bottom edge 16. The inner surface of the walls form a motion picture screen surface 18 that extends 300 degrees around the inside circumference of the building.

The platform 20 has a top surface 21 and a bottom surface 22. The steel platform is designed to accomodate 50 to 100 people in aircraft seats 24 equipped with harness-type seat belts. Since the platform would be approximately 8 to 10 feet above the ground surface, a pair of steps 26 would be utilized by the patrons of the theater to get from ground level to their seats on the platfrom.

Hydraulically telescopic legs 30 have their top ends pivotally connected to the bottom surface of platform 20 and their bottom ends are pivotally connected to base plates on support surface 31. Conventional valves, hydraulic pumps, and electrical switches, would be utilized to actuate telescopic legs 30. The components are similar to the existing components used on robotics and aircraft simulators.

An eight channel sound system would have speakers 36 spaced around the interior perimeter of the building. A projector 40 would preferably be supported from the ceiling of the building on a cantilevered arm although it could be supported from the top surface of the platform. A 300 degree fish eye lens would be used in projector 40.

Figure 3:
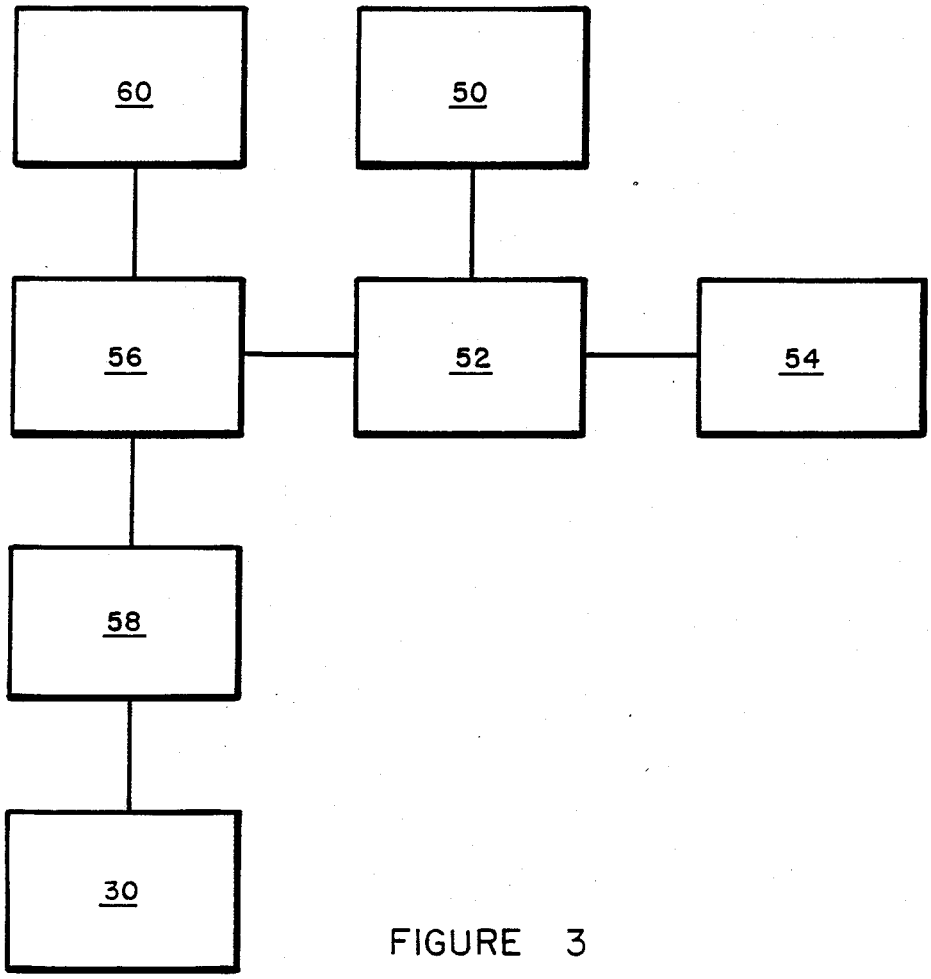
FIG. 3 is a schematic block diagram illustrating the electronic control system.

The electronic control system for the novel movie theater is shown schmatically in FIG. 3. It has an aperture console 50 having a visual display unit and keyboard that are for operating the main computer 52. Motion profiles are stored on floppy diskettes and new/different programs are loaded by means of operator commands entered at the keyboard. The human interface shall be menu-driven so as to minimize the amount of operator training required. With the command button situated on console 50 together with the emergency stop button, the operator activates the appropriate button to start the show that is produced from the sound and motion picture projection system 54.

Slave computer 56 sends the appropriate signals to control malves 58 that supply hydraulic fluid to activate hydraulically telescopic legs 30. The sub-system executes the servo control loops for all six hydraulic cylinders and also supplies power to drive the hydraulic valves.

Joystick 60 is used for motion programing platform 20. Essentially, the computer memorizes the platform motion described by the joystick and plays it back exactly the same way time after time. Motion profiles are digitally recorded by the computer. Imputs from projectors, laser lightings and flashers, strobe-lights, sound and hologram effects may be synchronized with inputs of the joystick.

What is claimed is:

1. An advanced state of the art movie theater comprising:

a building having walls that form its perimeter, said walls having a bottom edge, said building having a predetermined inner width, said building having an outer configuration that resembles a sphere that is missing its bottom curvature due to a horizontal plane that cuts through the lower half of the sphere and forms its bottom edge, said building is a geodesic dome formed of substantially identical triangular panels;

a platform having a predetermined width that is less than the inner width of said building, said platform having a top surface and a bottom surface;

a concave curved motion picture screen surface upon which a motion picture can be projected, said curved surface encompassing an arc of greater than 180 degrees and less than 310 degrees, said curved motion picture screen surface is the inside wall surface of said building;

said platform being located within said building and having its bottom surface spaced upwardly a predetermined height above the bottom edges of the walls of said building;

support means connected to the bottom surface of said platform for tilting said platform upwardly and downwardly in any direction about its vertical axis about all 360 degrees comprising at least three sets of hydraulically telescopic legs having their top ends pivotally connected to brackets connected to the bottom surface of said platform and their bottom ends are pivotally connected to base plates positioned on the support surface, each of said sets having two telescopic legs having a top end and a bottom end, the bottom ends of each respective set of telescopic legs being pivotally mounted adjacent each other while the respective top ends are pivotally mounted to laterally spaced brackets connected to the bottom surface of said platform such that said telescopic legs have an angular slope to them;

said motion picture screen surface surrounding said platform;

a motion picture projector having a 300 degree fish-eye lens that is oriented to project an image on said motion picture screen;

electronic control means for activating said support means for tilting said platform comprising a controller, at least one joystick, an operator console main computer, and a slave computer; and at least 10 seats mounted on said platform and oriented toward said motion picture screen to accomodate persons viewing a motion picture to be shown.

2. A movie theater as recited in claim 1 wherein said curved motion picture screen surface is the inside wall surface of said building.

* * * * *